United States Patent [19]

Krauch, Jr. et al.

[11] 4,259,906

[45] Apr. 7, 1981

[54] SHAPE CHARGE AGENT DISPOSING PROCESS

[75] Inventors: Robert E. Krauch, Jr., Towson, Md.; Thomas W. Tranberg, deceased, late of Harford County, Md., by Harriet R. Tranberg, executrix

[73] Assignee: The United States of America as represented by the Secretary of the Army, Washington, D.C.

[21] Appl. No.: 3,435

[22] Filed: Jan. 12, 1979

[51] Int. Cl.[3] ..... F42B 11/22

[52] U.S. Cl. ..... 102/56 SC; 102/24 HC; 102/52; 102/92

[58] Field of Search ..... 102/24 HC, 56 SC, 92, 102/52

[56] References Cited

U.S. PATENT DOCUMENTS

| | | | |
|---|---|---|---|
| 2,780,995 | 2/1957 | Migliaccio | 102/56 SC |
| 2,972,948 | 2/1961 | Kray | 102/56 SC |
| 3,100,445 | 8/1963 | Poulter | 102/56 SC |
| 3,661,086 | 5/1972 | Thomanek | 102/56 SC |

FOREIGN PATENT DOCUMENTS

| | | | |
|---|---|---|---|
| 1283312 | 12/1961 | France | 102/24 HC |
| 1400814 | 4/1965 | France | 102/56 SC |

*Primary Examiner*—Harold J. Tudor

*Attorney, Agent, or Firm*—Nathan Edelberg; Robert P. Gibson; A. Victor Erkkila

[57] ABSTRACT

A system and method of disseminating lethal and non-lethal agent within a target to cause respiratory and occular irritation to animals therein by the use of an agent carrying shaped charge munition. Agent is located in a disposer of special trucated cone shape. The disposer is located in the forward end of the projectile munition. As the projectile impacts and forces its way through a target wall, for example, the special shape of the disposer gives it temporary integrity to withstand external forces and contain this agent until target penetration is realized. The agent is loaded into the disposer and it is assembled to the munition.

4 Claims, 2 Drawing Figures

SHAPE CHARGE AGENT DISPOSING PROCESS

DEDICATION CLAUSE

The invention described herein may be manufactured and used by or for the U.S. Government for governmental purposes without the payment of any royalties thereon or therefor.

BACKGROUND OF THE INVENTION

The present invention relates generally to the field of munitions and more particularly to the agent dispersing munitions of the shaped charge type.

Those working in the field of munitions research and development are continually engaged in an effort to dispense the payload to result in optimum performance. This had led to much research in attempts to eliminate or at least alleviate payload waste or dispersion outside the target area. Specifically, dealing with payload agent dispersion, researchers have been plagued with the problem of being able to control it and to enable optimum results to be had at the target site.

It is well known to disperse agents of either the lethal or the non-lethal variety by the use of munitions. That is, various contemporary munitions have been developed and are in use which carry payload agent material which is dispersed by exploding the munition in the atmosphere. Conventionally, the agent is dispersed by the exploding forces of the munition by non-pyrotechnic gas or pressure means in the munitions, or it is left to be dispersed by the atmosphere, i.e., wind, rain and convection currents after case fracture. Various conventional modes of delivery by way of munitions have been used, i.e., generators, rockets, missiles, grenades, bombs, etc. However, until the instant invention, success with agent dispersion has been had mainly in the open atmosphere and has, except for limited cases, not been possible where the interior of a target has first been penetrated and the agent dispersed therein. It has been done, for example, by sending a munition containing an agent through easily penetratable target structures or portions thereof, like cloth, fabric and window glass, but never by penetrating heavy wall target structures and then dispersing the agent therein.

Before the instant invention, agents could not be dispersed within a heavy target structure. This was so because the problem of penetrating the target always served to disperse all the agent outside the target and essentially negate agent affect. That is, the explosive force necessary to penetrate the heavy target structure had to be of such a magnitude that the agent would be dispersed at impact, by way of the explosion and very little affect was had from the agent within the target structure. Hence, a long felt need has existed for an agent munition which could first penetrate a target and then dispense the agent after penetration.

SUMMARY OF THE INVENTION

Briefly stated, our invention is a new munition and method of assembling and using it. It comprises basically a munition and all the necessary components thereof, further including explosive charge material and an agent filled container or disposer located forward of said charge. More specifically, the munition need only comprise, a casing or housing configured externally for desired trajectory and launching characteristics, and be adapted to contain the agent disposer in the forward interior thereof.

In operation, the munition is launched at the target by hand, by the use of a launcher or gun, or by self-propelling means and/or a combination of the above. At impact with the target structure, the explosive charge is detonated to further force the munition nose portion and the disposer through the exterior and into the target structure. Detonation of the explosive charge can be had by any of the conventional fusing means. At impact with the target structure, the necessary energies developed in the launch and/or trajectory and that expended by the explosive charge, force the nose to either break, fracture, and/or deform it. Once this occurs, the explosion of the shaped charge of the munition completes the boring, breaking and fracturing of the target structure wall, if necessary, and thereby penetrates the interior thereof. Due to the above mentioned single or combined effects on the disposer, it is either distorted, fractured or partially melted to thereon expose the agent and enable it to escape and permeate the target structure interior by at least being sucked through the hole. It is theorized that the shaped charge explosion collapses the cone at its extremities and causes the charge to bypass it.

The charge is preferably one which will create localized or directed force in a forward direction so as to cause the forward part of the munition and associated forces to bore and cut its way through the target structure wall. The best mode we have found to do this is by the use of a shaped charge load. Though, it is within the purview of the instant invention to use other casing and nose designs to accomplish the same end.

The disposer, encloser, or container filled with agent is preferably of a design whereby it must maintain its integrity but yet it must have the built-in self-distorting and destructive features so that the agent can escape. The parameters of design can be varied depending upon the results desired therefrom. The forward portion is strong and preferably deformable. The remainder of the disposer merely need be strong enough to temporarily hold the agent during initial target structure penetration. Because it is of deformable material and of a relatively lower melting point, melting does take place. However, because of the high explosive forces involved only prediction and hypothesis can serve to explain the phenomenon.

The principal object of this present invention is to disperse lethal or non-lethal agent within a remote target structure by the use of a munition which is launched into the atmosphere at said target.

Another object of our invention is to pierce, fracture, burn or cut an opening in a target structure and dispense agent therein.

Still another object of our invention is to use a container or disposer within a pyrotechnic munition which serves to contain the agent until the munition and/or said disposer is impacting the target structure.

A further object of our invention is to enable the agent to be pre-packaged in a fragile or weakened seamed container so that munition assembly problems are reduced.

A still further object of our invention is to use a disposer or container which can serve as a cutting and penetrating member in cooperation with the munition.

Another still further object of our invention is to provide a disposer or container that is shaped to properly locate and contain explosive shaped charge material in the munition and to create a timed delay so that the agent is dispersed after target structure penetration.

Other objects of our invention and advantages thereof will become more apparent from the drawings and detailed description and elaboration hereinafter set forth.

DESCRIPTION OF THE PREFERRED EMBODIMENT

Figure 1:
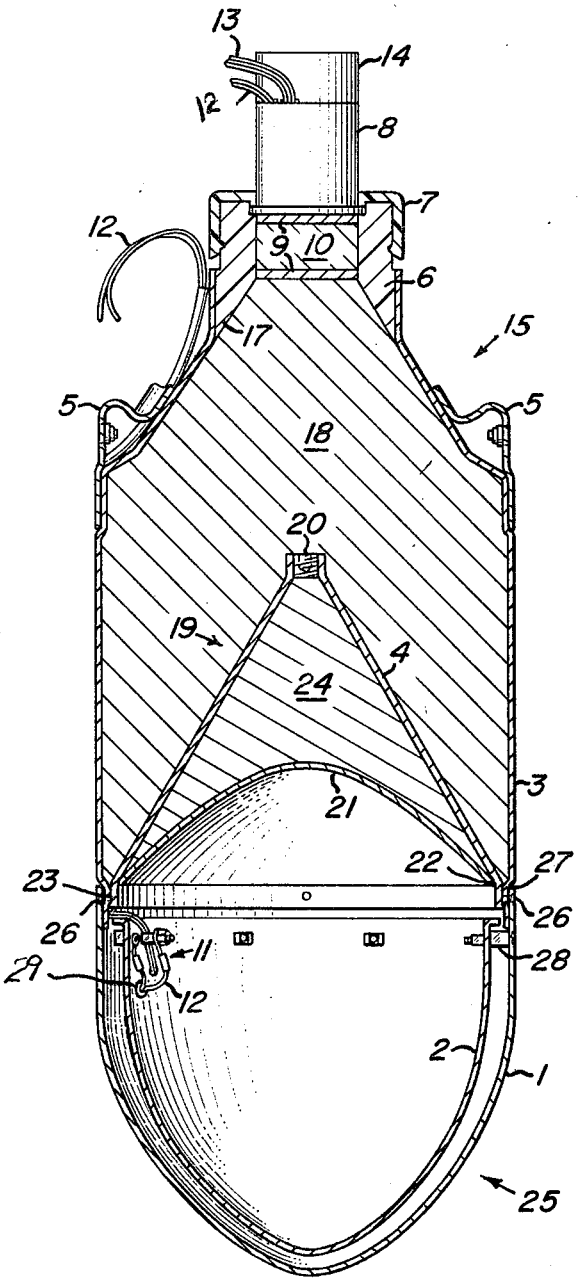
FIG. 1 shows our munition war-head invention in cross-section depicting the agent disposer and explosive charge material situated therein.

Referring to FIG. 1 of the drawing, numeral 15 depicts our agent war-head munition. It is propelled by a conventional rocket motor assemblage not shown and is of the missile variety. One piece body or casing 3 is made of metal and preferably of munition casing type steel. On the aft portion thereof, body parts or brackets 5 also of metal are securely fixed as by welding or riveting to receive the above mentioned rocket motor assemblage not shown. On the rear most portion of body 3 is an extruded metal sleeve 6 which is securely attached to the outer reduced portion of body 3 as by tight fitting, by bolt, by thread, by weldments, or by magnaforming not shown. Sleeve 6 has its forward portion 17 contoured to complement the interior shape of body 3. Within body 3 is located shaped charge explosive material 18 such as "Octol".

Forward of explosive 18 is agent container or disposer 19 comprising liner cone 4 of metal, preferably of aluminum, acting both to hold the explosive material 18 in proper position and to contain the agent 24 laterally within agent disposer or container 19. Rearmost of liner cone 4 is metal plug 20 threadably secured therein for agent filling purposes. Closing the forward portion of disposer 19 is paraboloid (Dish or Concave) shaped cap 21 preferably of aluminum which is sealably secured to liner cone 4 at joint 22 by a tolerance fit, magnaforming, resin, or weldments. It is critical that joint 22 be weaker than the metals of cap 21 and liner cone 4 in shear or tear strength especially if the disposer 19 does not have a detonating means for disseminating the agent from the disposer. If the disposer is used with a shaped charge, no significance is seen. Disposer 19 is tolerance fitted to body 3 at joint 23 with a friction or snug fit so that it will not be dislodged at launch or during handling. It allows for charge 18 expansion.

Nose 25, of metal and ogive shape, forms the forward-most portion of the war-head and circumferentially overlays body 3 at joint 27 and is secured thereto by bolts or screws 26. Ogive shaped nose 25 comprises outer cone 1 of aluminum and inner cone 2 of like material which function as a nose crush switch. Inner cone member 2 is electrically insulated and secured to outer cone member 1 by insulator assemblies 28 which comprise inwardly extending bolts over which spacer and through insulator sleeves pass to electrically isolate the inner cone 2 from the bolts and electrical continuity to outer cone 1. Electrical potential from the battery control system for the nose crush switch function of nose 25 is provided at terminal assembly 11. Terminal assembly 11 provides wire connection points for connecting wires 12 to outer and inner cones 1 and 2, respectively.

To the rear of body 3 is safety and arming device 8 and terminal board 14 secured to device 8. On the front portion of safety and arming device 8 is located a flange for holding it securely to body 3 at solid metal extrusion sleeve 6 by ring retainer 7.

For detonating explosive charge 18, pellet booster 10 of PBX is mounted and electrically fired within extrusion sleeve 6. Pellet booster 10 is in capsule from and is sandwiched compressibly between compressive pads 9 by the force applied at the forward face of safety and arming device 8 by way of ring retainer 7 on the flange of device 8, as aforesaid.

Safety and arming device 8 can be of any of the conventional types but primarily device 8 should be activated by inertia launch velocities. That is, with such a feature, no chance of accidental detination of booster 10 can occur. Here, device 8 will not complete electrical circuitry to its fuse and activate booster 10 until the munition is over 200 feet down range from the launch facility. Therefore, for activation, the safety and arming device completes the circuit to the fuse to arm the munition at a specific velocity or acceleration, and if necessary, has the feature of locking itself in the "go" position. This then enables the current from the battery (not shown) to flow through the device 8 by way of one of the conductors 13 to detinate the fuse and activate booster material 10 while flowing to cones 1 or 2. The current flows thereto by way of one of the conductors 12 and flows through the engaged cones 1 or 2 to the other conductor 12 back by way of device 8 out through the other conductor 13 to the other side of the battery (not shown). Rearward of safety and arming device 8 is located terminal block cover 14 of plastic insulative material such as hardened Bakelite or Epoxy, for example.

Figure 2:
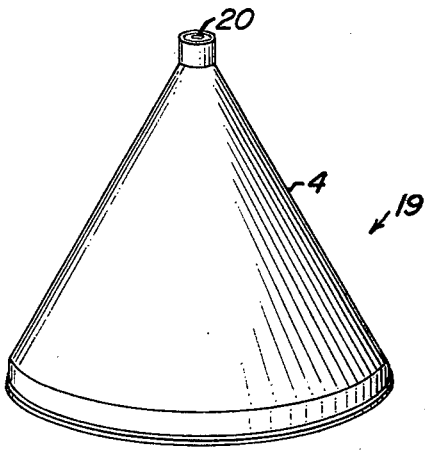
FIG. 2 is a view of the exterior of the agent disposer.

Disposer 19 of FIGS. 1 and 2 will now be described in more detail. Disposer 19, shown isometrically in FIG. 2 and in cross-section in FIG. 1, has cone shaped liner 4 for a purpose. It functions, as aforesaid, to define the shaped charge, i.e., the explosive material 18 to act as the explosive thrust surface, and to contain the agent 24 therein by way of its inner surface. Its frontmost surface 21 is of a paraboloid design. The right trucated cone shaped disposer cap is pressed of one piece aluminum stock. Though it is understood other materials with like characteristics will work as well. Also, plural components secured together to give the same result will be satisfactory. Disposer 19, or as it is sometimes called "enclosure", is filled at plug 20. That is, the disposer 19 is first constricted in the shape of that shown in FIG. 2 with cap 21 secured thereto at 22 so that it tears, shears, or factures at the appropriate time. It is also within the realm of the invention to have a reduced or weakened portion thereat or about to achieve this end. Cap 21 is dished inward or concave with the paraboloid shape as shown.

In practice, the invention munition of FIG. 1 (depicting part of a TOW missile) was used to penetrate 6 inch and 10 inch armor plate with adequate agent dispersion. The invention has been made by modifying the U.S. Army "TOW" missile P/N 10084327 so as to receive the disposer 19 as shown. Although other munitions could be used as well. The "TOW" Missile System, Guided Missile, Surface Attack, XBGM-71A Report 1 covering the year 1970 obtainable from U.S. Army Missile Command, is hereby incorporated by reference to show the conventional motor assembly, etc. used with FIG. 1.

In the aforementioned penetrations, the disposer or encloser 19 had a liner cone 4 of aluminum alloy 5052H36 with the following dimensions. The thickness was 0.1 inches (0.254 cm) with an approximate length of 4.1 inches (10.4 cm). The angle which the cone liner 4 extends axially outward from plug 20 is 30 degrees from the horizontal. The maximum diameter of liner 4 at joint 23 was 4.77 inches (12.12 cm). The width of joint area 23 was 0.38 inches (0.97 cm).

The Cap 21 affixed to the liner 4 had a maximum diameter of 4.5 inches (11.43 cm) and 0.63 (0.16 cm) inches thick. The paraboloid shape had a radius of 0.58 inches from the center line and measured perpendicularly 1.26 inches from a plane passing through the maximum diametric extent of cap 21, it had a 1.12 inch radius when measured perpendicularly 1 inch from said plane; it had a radius of 1.7 inches from said centerline as measured perpendicularly 0.59 inches from said plane; and it had a radius of 2.247 inches as measured on said plane.

Though the explosive force of charge 18 either mutilates, destroys or melts the disposer 19 beyond recognition, it is believed agent dispersion within the target can be explained in this way. The paraboloid cap 21 and liner 4 are collapsed as charge 18 detonates. This first occurs at the outer limits of the liner 4 thereby causing the liner 4 cone to collapse inwardly. When that occurs, the force is believed around the peripheral portion of the munition because the explosive 18 is located foremost. If collapse occurs, then the shape of cap 21 will function to enable the Agent 24 to be further consolidated and for a short time be confined. Then as the explosive developes to full strength, it is believed that the excessive heat developed will partially vaporize the cap and liner of disposer 19 while the explosion forces the munition, etc. through a target wall by fracturing, tearing, melting and/or burning. After partial vaporization of disposer 19, the forces of the explosion will suck certain of the agent 24 (though not contained) behind it. Therefore, some agent may be initially thrust forward with the shape charge forces while making a hole and the remainder of some of the agent may be sucked through by the advancing explosive gases. It is also reasoned that because the apex of the liner 4 by way of plug 20 is thickened by a pipe plug, for example, liner 4 vaporization will be delayed, thereby enabling more agent to be thrust into the target.

OPERATION

Once body 3, disposer 19, charge 18, safety and arming device 8, and the remainder of the motor assemblage not shown are cooperatively connected and affixed, the invention can be launched at a target.

First, safety and arming device 8 is activated to disconnect electrical circuitry to booster 10 and its fuse until the munition is over 200 feet down range. Then device 8 locks into arming or "go" position to complete all electrical circuits to the battery except nose crush switch 1, 2 which is open. At impact with the target outer switch cone member 1 is forced into electrical contact with inner cone member 2 to complete the electrical circuit flow and cause the fuse to activate pellet booster 10. Booster 10 detonates charge 18. The sequence of events are then in mil-seconds or shorter and only the above hypothesis can be looked to for an explanation of what could occur.

The use of our disposer in the form of a cutting tool is also perceived. By this use, one would be required to strengthen liner cone 4 and possibly provide the end thereof with a cutting edge.

The use of our disposer offers other advantages as well. By varying the size of plug 20 or the apex area, hole size at impact is modified. Also, by modifying the angle liner cone 4 makes with its apex bisector, and modifying the types of materials used on our disposer, varying results can be had. It is also understood that our disposer could be launched by sabot, cartridge, or aircraft in bomb form.

Obviously, many modifications and variations of the present invention are possible in light of the above teachings. It is therefore understood that within the scope of the appended claims the invention may be practiced other than as specifically described.

We claim:

1. A munition component for penetrating a target and disposing a physiologically toxic agent therein comprising:

a casing, a shaped charge explosive material positioned in said casing, a cone-shaped liner positioned in said shaped charge explosive material, said liner being closed at its forward end by a paraboloid-shaped cap, which curves toward the apex of said liner and thereby forms a closed chamber in said liner for containing said agent, a physiologically toxic agent contained in said chamber; and joint means for attaching said liner to said casing.

2. A munition component of claim 1 wherein said joint means permits expansion and contraction of the shaped charge explosive material.

3. The invention of claim 1 or 2 wherein the liner has a plug on its apex end.

4. A munition component for penetrating a target and disposing a physiologically toxic agent therein comprising:

a cone-shaped metal liner for positioning in the conical recess of a shaped charge explosive material.

a removable plug closure for the apex end of said liner, a paraboloid cap closure for the large end of said liner which curves toward the apex end of said liner, said plug and cap closures forming a chamber in said liner for containing said agent, and a physiologically toxic agent contained within said chamber.

* * * * *